US005535713A

United States Patent [19]

Braddock

[11] Patent Number: 5,535,713

[45] Date of Patent: Jul. 16, 1996

[54] COMBINATION FIELD BOX AND ENGINE STARTER FOR MODEL AIRPLANE ENGINES

[76] Inventor: Douglas J. Braddock, 8415 Sweet Pine Ct., Springfield, Va. 22153

[21] Appl. No.: 305,890

[22] Filed: Sep. 14, 1994

[51] Int. Cl.[6] ..... F02N 11/12

[52] U.S. Cl. ..... 123/179.27; 123/179.25; 74/7 C; 74/7 E

[58] Field of Search ..... 123/179.27, 185.7, 123/179.25, 179.26; 74/7 C, 7 E

[56] References Cited

U.S. PATENT DOCUMENTS

| | | | |
|---|---|---|---|
| 1,504,766 | 3/1920 | Knipfer | 123/179.27 |
| 2,404,419 | 6/1944 | Weatherly | 123/179.27 |
| 2,475,750 | 7/1949 | McCormick et al. | 318/447 |
| 2,625,143 | 1/1953 | Demitz | 123/185.7 |
| 3,190,276 | 8/1963 | Diggs | 123/179.27 |
| 3,696,593 | 10/1972 | Thorud et al. | 123/179.26 |
| 5,052,653 | 10/1991 | Coraccio | 248/674 |
| 5,095,865 | 3/1992 | Keister | 123/179.25 |

OTHER PUBLICATIONS

Article appearing in Mar., 1991 issue of *Model Aviation* entitled Safety Comes First by John Preston, pp. 16 and 69.

Article appearing in Jan., 1991 issue of *Model Aviation* entitled Safety Comes First by John Preston, pp. 14, 15, and 16.

Article appearing in Nov., 1990 issue of *Model Aviation* entitled Safety Comes First by John Preston, pp. 14, 16, and 18.

Article appearing in Mar., 1990 issue of *Model Aviation* entitled Safety Comes First by John Preston, pp. 14, 22.

*Primary Examiner*—Andrew M. Dolinar

*Attorney, Agent, or Firm*—Sixbey Friedman Leedom & Ferguson

[57] ABSTRACT

A combination field box and engine starter for model airplane engines is provided. The engine starter is mounted on the upper portion of one of the sidewalls of the portable field box. The field box includes a bracing assembly on the wall opposite to where the engine starter is mounted for preventing the box from sliding or tipping when pressure is applied to the starter during an engine starting operation. Additionally, the engine starter is provided with a torque enhancing gear train and an over-speed clutch which allows it to start relatively large model airplane engines with power generated by a compact battery pack formed from eight 1.2 volt nickel-cadmium cells.

29 Claims, 4 Drawing Sheets

COMBINATION FIELD BOX AND ENGINE STARTER FOR MODEL AIRPLANE ENGINES

BACKGROUND OF THE INVENTION

This invention relates to a combined field box and engine starter for model airplane engines having a bracing assembly that prevents the box from sliding or tipping during an engine starting operation. This invention also relates to a compact, lightweight starter assembly operated by a low-power electric motor and lightweight battery pack.

Although many model airplane engines can be started by flipping the propeller by hand, most modelers start their engines with an electric starter. Prior art electric starters are typically comprised of a relatively large twelve volt electric motor having a receiver cup directly attached to the motor output shaft. The receiver cone or cup is lined with rubber for frictionally engaging the spinner of the model airplane engine. The starter motor is usually powered from a heavy lead-acid or gel-cell twelve volt battery contained in a portable field box.

Field boxes for holding and transporting all of the accessories and equipment needed to start, operate, and maintain model airplanes are also well known in the prior art. Although the size and design of these boxes varies widely, a typical field box is made of plywood and would be about 1½ to 2 feet long, about 6 inches to a foot wide, and a foot or more high. Such field boxes and their contents may weigh in excess of 30 pounds, including the aforementioned prior art starter in combination with its twelve-volt lead-acid battery, a gallon fuel tank, a manual or electric fuel pump, radio transmitters in the case of radio-controlled model airplanes, and various tools and spare parts. The prior art starter with its large electric motor and lead-acid battery are often the heaviest pieces of equipment, often having a combined weight of between five and ten pounds.

In operation, the modeler first places the model airplane near the field box. With the model airplane resting on the ground, the modeler then grasps the airplane behind the propeller with one hand, and holds the starter in the other hand, which is connected to the twelve volt battery in the field box by way of appropriate wiring. Most such starters include a switch operated by the user which actuates the electric motor when the spinner of the model airplane engine is pressed into the rubber-lined receiving cup. Once the motor is actuated, the rubber-lined cup spins with the output shaft of the electric motor, turning the engine shaft.

While such prior art engine starters and field boxes are generally capable of performing their intended tasks, the applicant has noted a number of shortcoming associated with their use, the most severe of which is safety. When a prior art engine starter is operated in the aforementioned manner, the modeler is in front of the engine and propeller, where he is susceptible to injury if the engine goes to full speed unexpectedly due to, for example, radio malfunction or inadvertent movement of the throttle control. Injuries have also occurred when the modeler has attempted to adjust the engine from such a front position while reaching over the spinning propeller. The awkward squatting or kneeling position that the modeler must assume when starting the engine in this fashion increases the chances of accidental contact with the spinning propeller. In addition to the possibility that the modeler may inadvertently come into contact with the spinning blade, a hard object may sometimes accidently fall into the spinning propeller. Additionally, a propeller may unexpectedly throw a blade. In such cases there is a risk of injury because objects or propeller blades tend to fly forward or outward, where they may strike a modeler kneeling close in front of the airplane. Due to the trend toward larger and more powerful engines (some of which have two horse power or more), and because of the common use of sharp-edged, fiber-reinforced propellers that will not break even after striking a body part, injuries can be severe. Severed fingers, permanent tendon damage, and even life threatening wounds have been sustained by modelers attempting to start engines while kneeling in front of their airplanes.

The lead-acid batteries used in conjunction with such prior art electric starters exacerbate these safety problems. Such batteries require the use of dangerous sulfuric acid and can generate explosive gases. Care must be taken that they are always kept upright and are provided with ventilation. Since they are often sold without electrolyte, the user must go to the trouble of obtaining and adding the potentially dangerous sulfuric acid. While gel-cell batteries may be used instead of lead-acid batteries, these batteries are more expensive and are still about as heavy as lead-acid batteries. Finally, the use of such twelve-volt batteries requires the purchase of a dedicated charger for periodically recharging such batteries.

Still another shortcoming associated with such prior art engine starters is that, despite their great size and weight, many such prior art starters do not have sufficient torque to start the larger internal combustion engines which have recently become popular among modelers. This shortcoming could be partially overcome by using even larger, heavier, and more expensive starters and batteries. But presently, for the largest engines, there are no starters available which generate sufficient torque to start them reliably. Consequently, such large engines can only be started by hand. Finally, the combined weight of such prior art starters and field boxes makes them unwieldy and uncomfortable to carry over even relatively short distances.

Clearly, there is a need for an engine starter which is smaller, lighter, and easier to use than prior art engine starters but which is capable of starting even the largest model airplane engines. Ideally, such a starter would be provided with some sort of support means which would not only secure the starter in a conveniently accessible location without requiring the carrying of substantial additional weight, and which would also allow the modeler to assume a safe position well behind the propeller of the model airplane at all times during the starting operation. Finally, it would be desirable if the engine starter were capable of generating large amounts of torque without the use of a large and heavy 12 volt battery.

SUMMARY OF THE INVENTION

Generally speaking, the invention comprises a lightweight engine starting assembly for generating and applying high torque to an output shaft of an internal combustion engine, and a manually movable storage container or field box for both supporting the engine starting assembly in a position conveniently accessible for an engine starting operation, and containing and transporting accessories associated with the engine. To this end, the field box includes a wall for mounting the engine starting assembly, and a ground-engaging brace assembly for counteracting forces applied to the mounting wall resulting from the operation of the engine starting assembly.

The brace assembly preferably includes a pivotal coupling connected to a wall of the field box that opposes the wall that the engine starting assembly is mounted on, and one or two separate brace members. The coupling may be mounted adjacent to, or approximately the same height as the center of mass of the box. Each of the brace members includes an end that is connected to the pivotal coupling, and another end for engaging the ground. The pivotal coupling is preferably also a compliant coupling in order to accommodate any irregularities in the ground. The brace members are preferably nestable to facilitate storage, and the field box may include a fastening means in the form of a latch or screw for securing the nested brace members in a storage position against the wall of the box to which they are pivotally mounted.

Alternately, the ground-engaging brace assembly may include a foot brace member that includes a portion for receiving a foot of an operator to secure the field box against sliding or tipping during a starting operation. In this embodiment, the foot brace member is preferably extendable and retractable from a wall of the field box that is on the same side as the wall which mounts the engine starting assembly. Such a configuration allows an operator to simultaneously step upon the foot brace member while pushing the output shaft of the internal combustion engine in the engine starting assembly. Force applied to the engine starting assembly is transferred through the walls of the field box and from there as tension to the foot brace member, which prevents the box from tipping or sliding.

The field box includes vertically oriented sidewalls, and the mounting wall may be an upper portion of one of these sidewalls. The sidewall may include an upper edge that is obliquely oriented with respect to the horizontal, and the engine starting assembly may alternatively may be mounted on one of these obliquely oriented upper edges. Such an arrangement not only affords better access to the engine starting assembly, but also advantageously divides at least part of the force applied to the starter during a starting operation into a vertically oriented component that increases the frictional engagement between the bottom of the box and the ground, thereby helping to prevent the box from sliding or tipping. All embodiments of the box-mounted starter assembly allow the modeler to start the engine of the model in a more tipright and comfortable position located safely behind the engine.

The engine starter of the invention generally comprises a torque generating mechanism that includes an electrically powered motor, and a gear train connected to the motor for amplifying the torque generated by the output shaft of the motor so that sufficient torque to start even the largest engines is generated. A receiver cup is connected to the output of the gear train for receiving the output shaft of an internal combustion engine and transferring the amplified torque to the engine shaft in order to start the engine. An over-speed clutch is disposed between the receiver cup and the gear train for mechanically disengaging the cup from the power train as soon as the internal combustion engine starts.

In the preferred embodiment, the gear train should amplify the torque generated by the electric motor by at least eight times, which allows the use of a relatively small battery power source. The battery is composed of eight, 1.2 nicad cells which can be recharged using the charger for the transmitter used for radio-controlled models, thus eliminating the need for a dedicated charger. Of course, this has the effect of slowing the resulting rotational speed of the torque generating mechanism to a point which is well below the operating speed of the engine shaft. However, the over-speed clutch prevents any damage from occurring to the gear train by immediately disengaging the receiver cup from the gear train as soon as the engine starts.

BRIEF DESCRIPTION OF THE SEVERAL FIGURES

DETAILED DESCRIPTION OF THE PREFERRED EMBODIMENT

Figure 1:
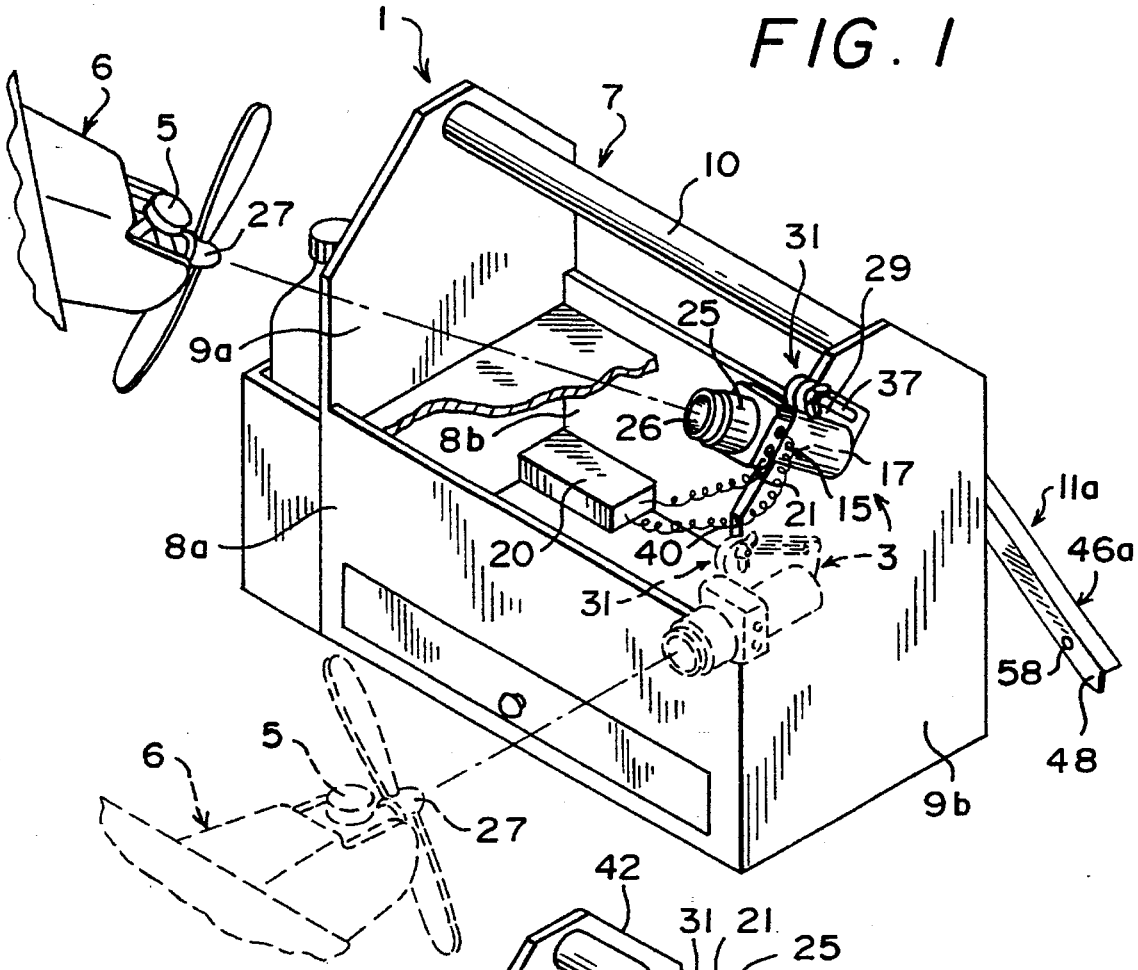
FIG. 1 is a front perspective view of the combination portable field box and engine starter of the invention, illustrating how the position of the starter may be adjusted on one of the vertical sidewalls of the field box in order to start model airplanes in either a horizontal or an oblique position.
Figure 2:
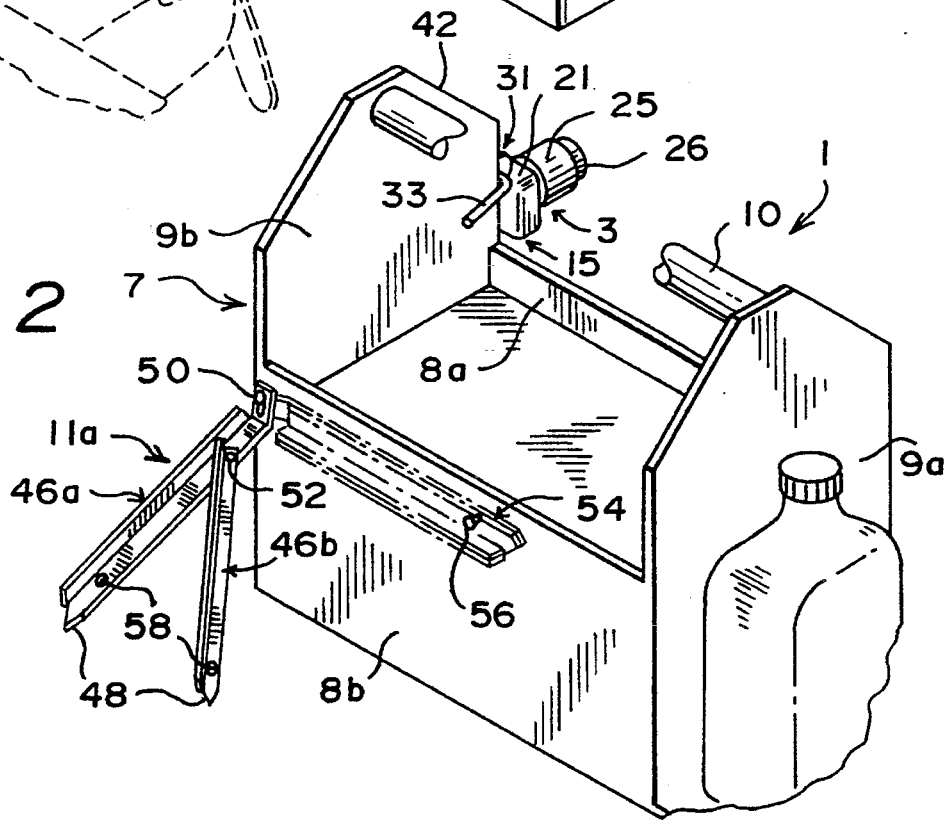
FIG. 2 is a back perspective view of the combination field box and engine starter of FIG. 1, illustrating how a first embodiment of the brace assembly may be pivotally moved from a ground engaging position into a nested, storage position.
Figures 5, 6:
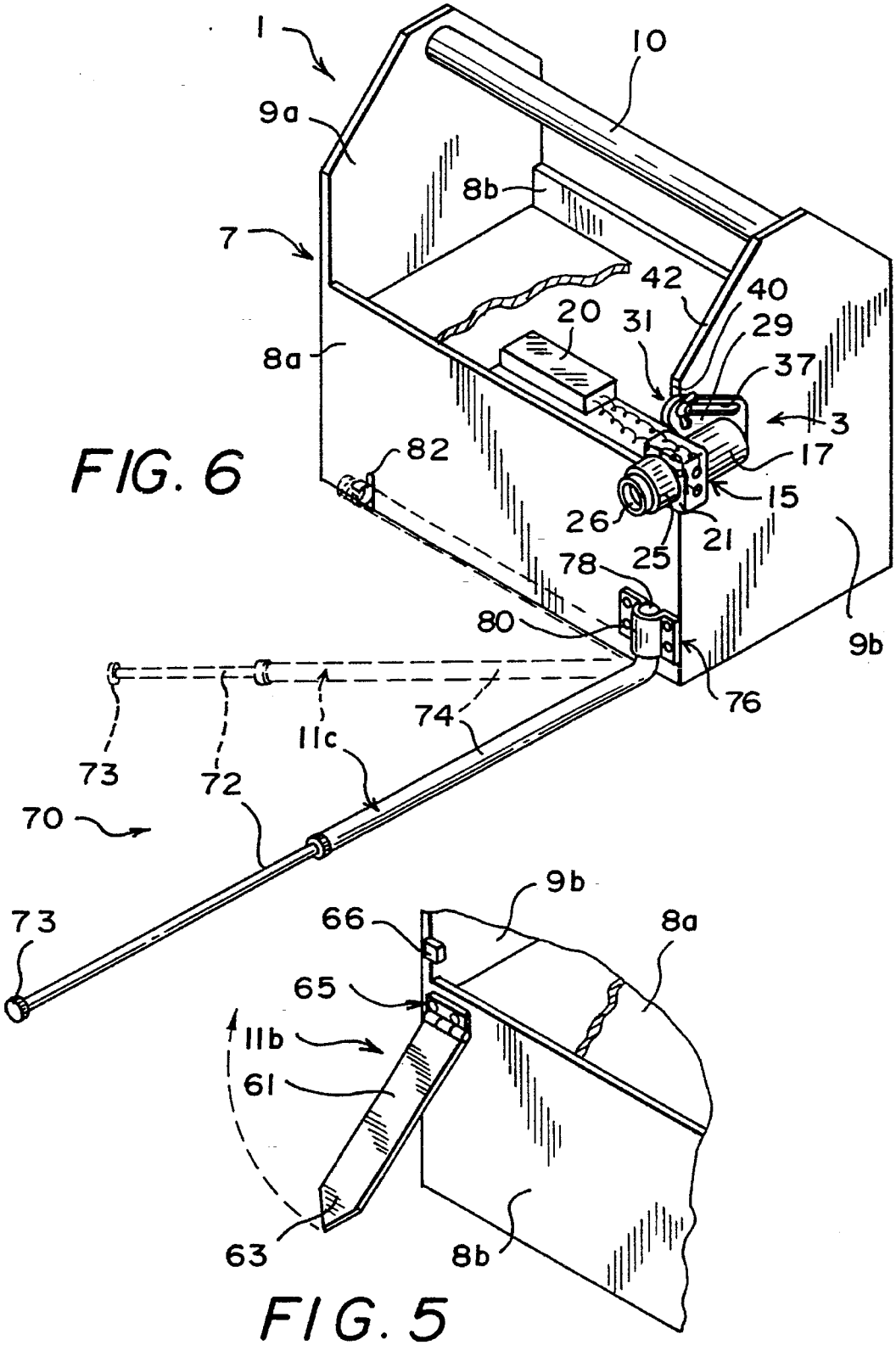
FIG. 5 is a partial back perspective view of an alternative embodiment of the invention illustrating how the ground engaging brace assembly may take the form of a single brace member.
FIG. 6 is a front perspective view of the field box and engine starter of the invention illustrating how the brace assembly may take the form of a telescoping foot brace.

With reference to FIGS. 1 and 2, wherein like numerals designate like components throughout all the several figures, the invention generally comprises the combination of an engine starting assembly 3 for starting the engine 5 of a model airplane 6, and a portable field box 7 for carrying accessories for the engine 5 and airplane 6 such as fuel, radio transmitting equipment, batteries, etc. The portable field box 7 may be a plywood tool-type box having front and back walls *8a,b* and sidewalls *9a,b* having upper portions that extend above the front walls as shown. The upper portions of the sidewalls *9a,b* support the ends of a tubular carrying handle 10. The upper portion of one of the sidewalls *9b* is used to support the engine starting assembly 3 in either an oblique, upwardly canted position or a horizontal position as shown in phantom. In the horizontal position, the engine starting assembly 3 is connected to the upper end of one of the side edges of the side wall *9b*. This position is preferred when the engine starting assembly 3 is used to start the engines of large model airplanes which can be rolled into the starter on their landing gear. In the oblique position illustrated in phantom, the engine starting assembly 3 is mounted on an upper edge of the sidewall *9b*. Such an oblique positioning is preferred when the engine starting assembly 3 is used to start the engines of smaller model airplanes. The oblique position has the advantage of minimizing the amount of crouching or squatting the modeler will have to undergo in order to engage the spinner of the airplane 6 to the engine starting assembly 3. It further has the advantage of diverting some of the force that the modeler applies between the airplane engine 5 and the starting assembly 3 into a vertically oriented force component that increases the frictional engagement between the bottom of the portable field box 7 and the surrounding ground. To keep the portable field box 7 from tipping or sliding along the ground during an engine starting operation, a ground engaging brace assembly 11a is provided on the wall 8*b* very near the side edge of wall 9*b*. While the ground engaging brace assembly 11*a* is preferably a pair of nestable angle irons that can be pivoted up into a storage position (as shown in phantom in FIG. 2), it may alternatively be formed from a single brace member 11*b* as illustrated in FIG. 5, or a telescoping foot brace assembly 11*c* as illustrated in FIG. 6. Each of these mechanisms will be described in more detail hereinafter.

Figure 3:
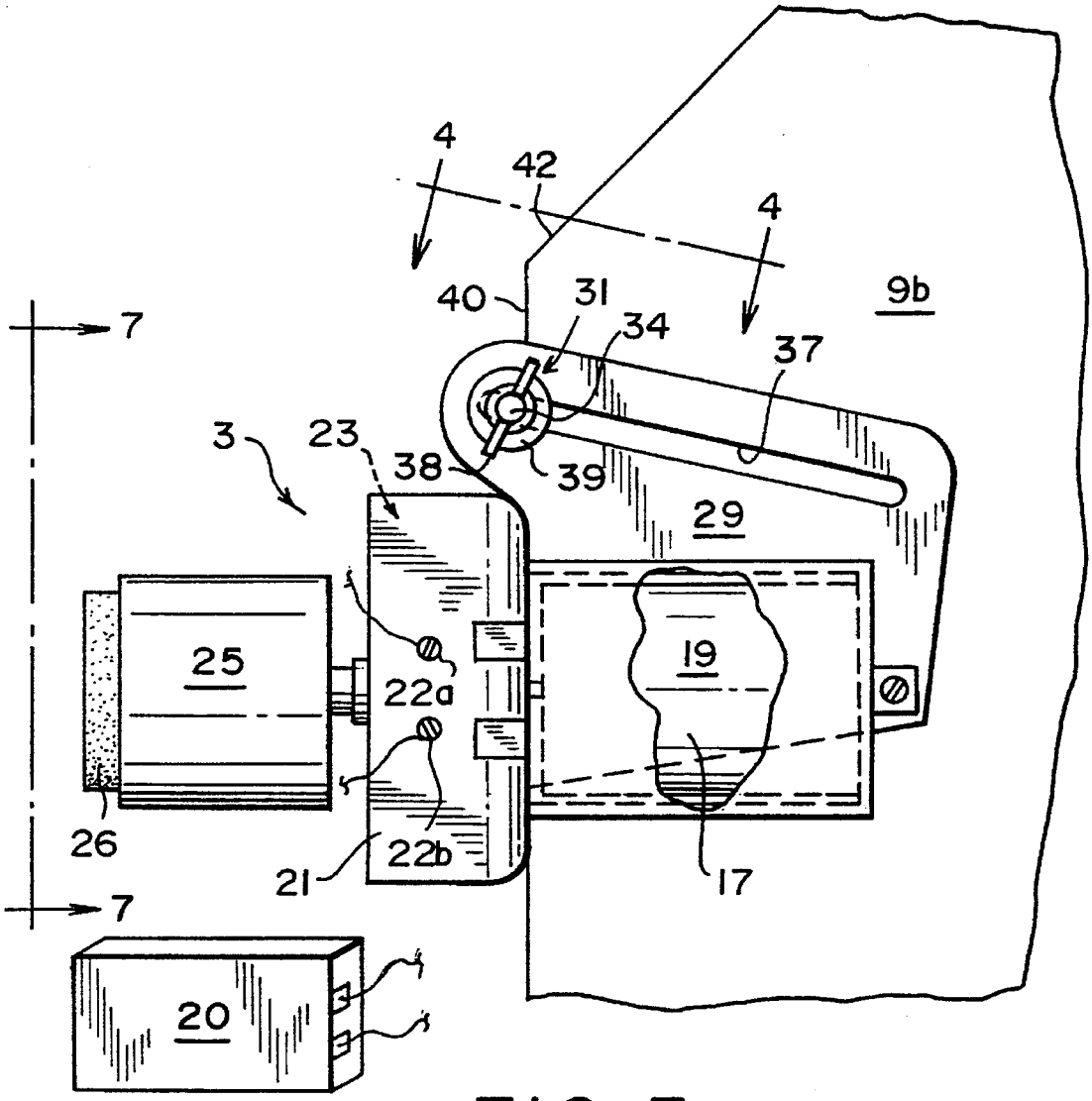
FIG. 3 is an enlarged side view of the engine starting assembly of the invention illustrated in FIG. 1.
Figure 4:
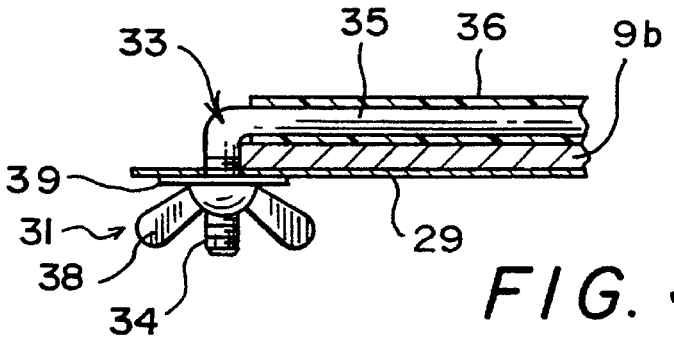
FIG. 4 is an enlarged upper view of the engine starting assembly of FIG. 3 along the line 4—4, illustrating how the mounting mechanism secures the engine starting assembly to one of the sidewalls of the field box.

With reference now to FIGS. 3 and 4, the engine starting assembly 3 is surrounded by a housing 15 that comprises a cylindrical compartment 17 that contains an electric motor 19, and a rectangular compartment 21 for housing a gear train and clutch assembly 23. A pair of terminals 22*a,b* project off of the walls of the rectangular compartment 21 connecting the motor 19 to a battery pack 20 formed from eight, 1.2 volt cadmium cells.

Figure 7:
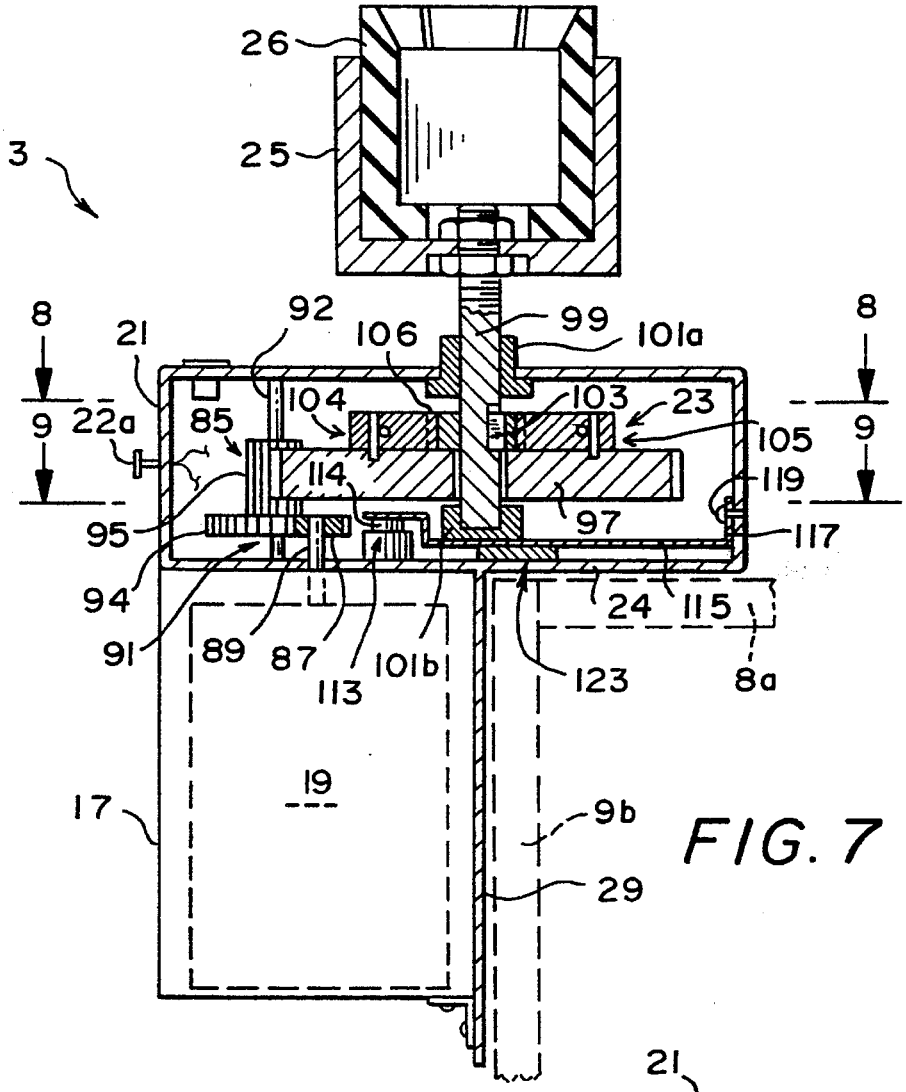
FIG. 7 is a cross-sectional view of the engine starting assembly along the line 7—7 of FIG. 3 as it would appear without the mounting mechanism.

With reference now to FIGS. 3, 4, and 7, the rear face of the rectangular compartment 21 that is opposite of the cylindrical compartment 17 defines a partition-engaging wall 24 that assists trapezoidal flange 29 and mounting mechanism 31 in securing the housing 15 to the upper edge of a sidewall 9*b* of the portable field box 7. Extending out of the front of the housing 15 is the drive cup 25 of the starting assembly 3. The drive cup 25 includes a rubber lining 26 for receiving and frictionally engaging the spinner 27 attached to the output shaft of the engine 5 of model airplane 6.

Integrally formed with the flat sidewall of the cylindrical compartment 17 of the housing is the previously mentioned trapezoidal flange 29. The flange 29, in combination with mounting mechanism 31, is used to secure the engine starting assembly 3 in either the two positions illustrated in FIG. 1. To this end, the mounting mechanism 31 includes a bracket 33 having a right-angled, threaded end 34, and a clamping end 35. The clamping end 35 is surrounded by a plastic sleeve 36 to enhance its grip against the inner surface of sidewall 9*b*. The trapezoidal flange 29 includes an elongated slot 37 for receiving the angular threaded end 34 of bracket 33. The combination of a wing nut 38 and washer 39 is used to pull the angular threaded end 34 of the bracket 33 through the slot 37, thereby securely clamping the upper portion of the sidewall 9*b* between the flange 29 and the bracket 33. The provision of an elongated slot 37 in the flange 29, instead of an aperture, allows the engine starting assembly 3 to be angularly adjusted, whether the engine starting assembly 3 is mounted to the vertical edge 40 of the sidewall 9*b*, or the oblique upper edge 42 as illustrated in FIG. 1.

With reference again to FIG. 2, the brace assembly 11*a* generally comprises a pair of brace members 46*a,b*, each of which includes a tapered, ground engaging tip 48. The brace members 46 are connected to the wall 8*b* opposite from the side of the field box 7 that the engine starting assembly 3 is mounted on by means of a compliant pivotal coupling 50. Preferably, the pivotal coupling 50 is connected to the wall 8*b* at approximately the same height as the center of gravity of the field box 7 so that the brace members 46*a,b* can impart a maximum resistance against any sliding or tipping movements that the forces associated with the use of the engine starting assembly 3 might initiate. In the embodiment of the invention illustrated in FIGS. 1 and 2, a second pivotal connection 52 is provided between the brace member 46*b* and the brace member 46*a* in order to render the two brace members (which may be formed from angle iron stock material) nestable for storage purposes. However, both of the brace members 46*a,b* can also be joined to the opposing wall 8*b* of the field box 7 by way of the pivotal coupling 50 if desired. To further facilitate storage of the brace assembly 11*a* when it is not in use, a latch 54 is provided on the opposing wall 8*b* which may be formed simply from a screw head 56 in combination with apertures 58*a,b* in the brace members 46*a,b*. The apertures 58*a,b* are large enough to admit the screw head 56 so that members 46*a,b* may be captively held between the screw head 56 and the surface of the opposing wall 8*b* as shown in phantom.

FIG. 5 illustrates an alternative embodiment 11*b* of the brace assembly. In this embodiment, the brace assembly 11*b* includes only a single brace member 61 having a tapered, ground engaging tip at one end, and a hinge connection 65 at its other end. The hinge connection 65 may simply be formed from a hinge as shown that is attached by two screws as shown. The brace 61 may be swung into a vertical position for storage. In this position, it would be held in place by a magnetic latch 66.

FIG. 6 illustrates a third embodiment 11*c* of the brace assembly of the invention. In this embodiment, the brace assembly 11*c* generally comprises a foot brace assembly 70 that includes a telescoping rod 72 that terminates in a bead 73 that facilitates the insertion or withdrawal of the member 72 from a cylindrical telescopic housing 74. At its proximal end, the telescopic housing is bent into a right angle, and is further attached to a bottom portion of the front wall 8*a* of the field box 7 by a pivotal coupling 76. In the coupling 76, the bent portion 78 at the proximal end of the telescope housing 74 is captured within the semicircular recess of a bracket 80. A spring-clamp type latch 82 is provided on the front wall 8*a* opposite from the pivotal coupling 76 to allow the telescoping foot brace assembly 70 to be placed into the storage position illustrated in phantom. Unlike the previously described brace assemblies 11*a,b*, the telescoping foot brace assembly 70 is mounted on the front wall 8*a*, and is operated by pulling it into the extended position illustrated in FIG. 6, and stepping on the telescoping member 72 while the spinner 27 of a model airplane 6 is pushed into the drive cup 25 of the engine starting assembly 3.

Turning now to FIG. 7, the gear train and clutch assembly 23 of the engine starting assembly 3 includes a gear train 85 for reducing, on an 8 to 1 basis, the output of the electric motor 19. To this end, the gear train 85 includes a drive gear 87 connected to the output shaft 89 of the motor 19. The drive gear 87 is engaged to an idler gear assembly 91 rotatably mounted across the walls of the rectangular compartment 21 by way of a shaft 92. The idler gear assembly 91 includes a transmission gear 94 that directly meshes with the drive gear 87 of the motor 19, as well as reducing gear 95 that has a smaller outer diameter than the transmission gear 94. The reducing gear 95 in turn meshes with a driven gear 97 of relatively large diameter. The driven gear 97 is freely rotatable on a shaft 99 that is connected to the drive cup 25 of the starter assembly 3. The drive shaft 99 is journaled in a rotary bearing 101*a* mounted on a wall of the rectangular compartment 21 of the housing 15. One end of the drive shaft 99 is of course connected to the drive cup 25, while the other end is journaled in a thrust bearing 101*b*. The drive shaft 99 is axially slidable a limited extent within the rotary bearing 101 a for actuating switch 113, as will be described in detail hereinafter. It should further be noted that the drive shaft 99 includes a radially oriented key 103 at its middle portion just above the top face of the drive gear 97 which connects a ratchet gear 106 to the shaft 99.

Figure 8:
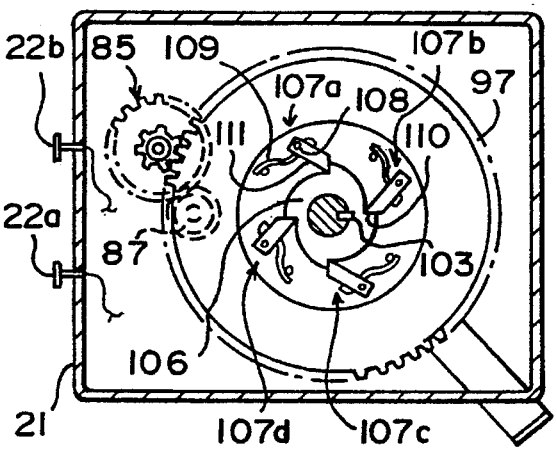
FIG. 8 is a cross-sectional view of the engine starting assembly of FIG. 7 along the line 8—8, illustrating the over-speed clutch of the drive train.

With reference now to FIGS. 7 and 8, the gear train and clutch assembly 23 includes an over-speed clutch 104 that is connected to the top face of the driven gear 97 by means of pins 105 as shown. The over-speed clutch includes four, spring loaded pawls 107*a–d* uniformly disposed along the inner diameter of the clutch body 106 at 90° intervals. Each of the spring loaded pawls 107*a–d* is pivotally mounted to the driven gear 97 by means of a pin such that it can pivot in and out with respect to the ratchet gear 106. Pawl springs 109 resiliently bias each of the pawls 107*a–d* toward the outer surface of the ratchet gear 106. Additionally, each of the pawls 107*a–d* includes a ratchet engaging end 110, as well as key slip surfaces 111.

Figure 9:
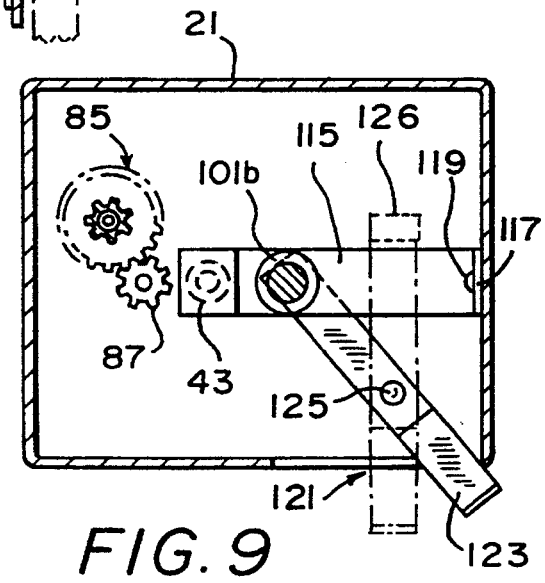
FIG. 9 is a cross-sectional view of the engine starting assembly of FIG. 7 along the line 9—9 illustrating part of the gear train and the pressure actuating switch for the electric motor.

With reference now to FIGS. 7 and 9, a switch assembly 113 is disposed beneath the driven gear 97 for actuating the motor 19 whenever axial pressure is applied to the drive cup 25. The switch assembly 113 includes a button-type, pressure responsive contact switch 114 that will conduct an electric current whenever the button of the contact switch 114 is depressed. An actuation bracket 115 is disposed beneath the thrust bearing 101*b* of the drive shaft 99 for depressing the button of the contact switch 114 whenever axial pressure is applied to the drive shaft 99. One end of the bracket 115 is cantileverly mounted on a wall of the rectangular compartment 21 of the housing 15 by means of a flange 117 and rivet 119, while the free end of the bracket 115 is disposed over the button-type contact switch 114 as shown. To prevent the inadvertent actuation of the engine starting assembly 3, the switch assembly 113 includes a safety 121. Safety 121 is formed from a deactuating lever 123 pivotally mounted to a bottom wall of the rectangular compartment 21 by means of rivet 125. The distal end of the deactuating lever 123 includes a thickened portion 126 which is pivotally movable in a position between the actuating bracket 115 and the bottom wall of the rectangular compartment 21 in the vicinity of the thrust bearing 101*b*. When the thickened portion 126 is pivoted into the position illustrated in FIGS. 7 and 9, the drive shaft 99 cannot be moved a sufficient axial distance to actuate the button-type contact switch 114. When, however, this lever is manually moved into the position illustrated in phantom in FIG. 9, the button-type contact switch 114 can be actuated upon the application of a moderate amount of pressure to the drive cup 25 by the spinner 27 of the model airplane 6.

In operation, the modeler first moves the deactuating lever 123 of the switch safety 121 into the position illustrated in phantom in FIG. 9. He next pushes the spinner 27 of a model airplane 6 into the rubber lining 26 of the drive cup 25 until the button-type contact switch 113 is actuated. The actuation of the switch 114 connects the electric motor 19 to the battery pack 20, which in turn causes the drive gear 87 to drive the driven gear 97 through the idler gear assembly 85. Torque is transmitted from the driven gear 97 to the annular clutch body 106 by means of the pins 105, whereupon the ratchet engaging ends 110 of one of the spring loaded pawls 107*a–d* apply torque to the ratchet gear 106 of the drive shaft 99 of the drive cup 25. As soon as the engine 5 of the model airplane 6 fires, the flat gear surfaces of the ratchet gear 106 disengage the end 110 of the particular pawl 107*a–d* driving it, which allows the shaft 99 to freely rotate within the bearings 101*a,b* as the rounded gear surfaces of the gear 106 slip over the key slip surfaces 111 of the pawls 107*a–d*. The modeler then withdraws the spinner 27 of the model airplane 6 from the drive cup 25, which in turn releases pressure from the button-type contact switch 114, thereby deactuating the starter assembly 3 by cutting off the electric motor 19 from the battery pack 20.

What Is claimed:

1. A combination portable storage container and engine starter, comprising:

an engine starting assembly having means for generating and applying torque to an output shaft of an internal combustion engine to start the engine when said engine shaft is engaged against said assembly, and a portable storage container for both containing and transporting accessories associated with an engine and for supporting said engine starting assembly in a position accessible for an engine starting operation, wherein said container includes a front portion for mounting said engine starting assembly, a back portion in opposition to said front portion, and a rigid, ground engaging brace means connected to said opposing back portion of said container for counteracting forces applied to said front portion of said container resulting from the engagement of said engine shaft against said engine starting assembly.

2. The portable storage container and engine starter defined in claim 1, wherein said brace means includes at least one brace member, and means for compliantly connecting said brace member to a back wall of said container that opposes said front portion that said engine starting assembly is mounted on.

3. The portable storage container and engine starter defined in claim 2, wherein said brace means includes a pivotal connection means, and a pair of brace members, each of which includes an end that is pivotally connected to said opposing wall by said connection means, and another end for engaging the ground.

4. The portable storage container and engine starter defined in claim 3, wherein said brace members are nestable, and further comprising a means for securing said brace members in a nested storage position on said opposing wall when said brace members are not in use.

5. The portable storage container and engine starter defined in claim 2, wherein said compliant connection means is connected at a point on said opposing wall that is about the same height as the center of mass of the container.

6. The portable storage container and engine starter defined in claim 1, wherein said container includes vertically oriented sidewalls, and wherein said engine starting assembly is mounted on an upper front portion of one of said sidewalls.

7. The portable storage container and engine starter defined in claim 6, wherein one of said sidewalls has a upper edge that is obliquely oriented with respect to the horizontal, and wherein said engine starting assembly is mounted on said oblique upper edge.

8. The portable storage container and engine starter defined in claim 1, wherein said engine starting assembly includes a means for pivotally mounting said assembly on said front portion of said container such that the angular orientation of said assembly is adjustable.

9. A combination portable field box and engine starter for internal combustion engines used in model airplanes, comprising:

an engine starting assembly having means for generating torque, cup means for receiving an end of a propeller shaft of a model airplane engine and transmitting torque from said torque generating means to said shaft when said propeller shaft is engaged against said cup means of said assembly, and a portable field box for both containing and transporting model airplane accessories and for supporting said engine starting assembly in a position accessible for an engine starting operation, wherein said box includes a front portion for mounting said engine starting assembly, a back portion in opposition to said front portion, and a rigid, ground engaging brace means connected to said opposing back portion of said box for preventing said box from tipping or sliding over the ground when said propeller shaft is engaged against said cup means of said engine starting assembly.

10. The combination portable field box and engine starter defined in claim 9, wherein said brace means includes at least one brace member movably mounted on said back portion of said box that is movable from a storage position adjacent to the surface of said box to a bracing position in contact with the ground.

11. The combination portable field box and engine starter defined in claim 9, wherein said brace means includes a pivotal connection means, and a pair of brace members, each of which includes an end that is pivotally connected to said opposing box portion by said connection means, and another end for engaging the ground.

12. The combination portable field box and engine starter defined in claim 11, wherein said pivotal connection means compliantly as well as pivotally connects said member ends to said opposing box portion.

13. The combination portable field box and engine starter defined in claim 9, wherein said box includes vertically oriented sidewalls, and said front portion is an upper front portion of one of said sidewalls.

14. The combination portable field box and engine starter defined in claim 9, wherein the box includes vertically oriented sidewalls, and wherein one of said sidewalls has a front upper edge that is obliquely oriented with respect to the horizontal, and wherein said engine starting assembly is mounted on said oblique upper edge.

15. The combination portable field box and engine starter defined in claim 9, wherein said torque generating means of said engine starter assembly includes an electrically powered motor having an output shaft; and a power train having an input shaft connected to said motor output shaft, and an output shaft connected to said cup means wherein said power train increases the amount of torque applied to said cup means by said motor.

16. The combination portable field box and engine starter defined in claim 15, wherein said power train amplifies the rotary output of said electrically powered motor by at least 4 to 1.

17. An engine starter for an internal combustion engine, comprising:

a torque generating means including an electrically powered motor having an output shaft and a power train connected to the output shaft of said motor for amplifying torque generated by said motor, said train having an output shaft that rotates substantially slower than an output shaft of said electrically powered motor;

a cup means connected to an output shaft of said power train for receiving the output shaft of an internal combustion engine and transferring said amplified torque to said engine shaft to start said engine;

an over-speed clutch means for mechanically disengaging said cone means from said power train, when said internal combustion engine starts;

a housing for containing said over-speed clutch means and power train, and a pressure actuated switch contained within said housing for receiving pressure applied to said cup means by said output shaft of said internal combustion engine and actuating said electrically powered motor.

18. The engine starter as defined in claim 17, wherein said power train amplifies the torque generated by said electric motor by at least four times.

19. The engine starter as defined in claim 17, further comprising a rechargeable battery pack for powering said electrically powered motor.

20. The engine starter as defined in claim 17, further comprising a ratchet means connected to said cone means for rendering said cone means rotatable in only one direction.

21. A combination portable storage container and engine starter, comprising:

an engine starting assembly having means for generating and applying torque to an output shaft of an internal combustion engine to start the engine, and a portable storage container for both containing and transporting accessories associated with an engine and for supporting said engine starting assembly in a position accessible for an engine starting operation, wherein said container includes vertically oriented sidewalls, one of which has an upper edge that is obliquely oriented with respect to the horizontal for mounting said engine starting assembly.

22. The portable storage container and engine starter of claim 21, further comprising:

a ground engaging brace means connected to a wall of said container for counteracting forces applied to said mounting wall resulting from the operation of said engine starting assembly.

23. The portable storage container and engine starter of claim 21, wherein said engine starting assembly further includes a cup means for receiving the output shaft of said engine, and a pressure actuated switch for receiving pressure applied to said cup means by said output shaft and actuating said means for generating and applying torque.

24. A combination portable storage container and engine starter, comprising:

an engine starting assembly having means for generating and applying torque to an output shaft of an internal combustion engine to start the engine, and a portable storage container for both containing and transporting accessories associated with an engine and for supporting said engine starting assembly in a position accessible for an engine starting operation, wherein said container includes a wall for mounting said engine starting assembly, and said engine starting assembly includes a means for pivotally mounting said assembly on said wall such that the angular orientation of said assembly is adjustable.

25. The portable storage container and engine starter of claim 24, wherein said portable storage container further includes a ground engaging brace means connected to a wall of said container for counteracting forces applied to said mounting wall resulting from the operation of said engine starting assembly.

26. A combination portable storage container and engine starter, comprising:

an engine starting assembly having means for generating and applying torque to an output shaft of an internal combustion engine to start the engine when said engine shaft is engaged against said assembly;

a portable storage container for both containing and transporting accessories associated with an engine and for supporting said engine starting assembly in a position accessible for an engine starting operation, said container including a wall for mounting said engine starting assembly, and a rigid, ground engaging foot brace member connected to a bottom portion of said storage container and having a portion for receiving the foot of an operator to counteract forces applied to said mounting wall of said container resulting from the engagement of said engine shaft against said engine starting assembly, wherein said rigid brace member is resistant to movement not in a plane parallel to the bottom of said container.

27. The portable storage container and engine starter of claim 26, wherein said ground engaging foot brace member includes a rod telescopically mounted in a cylindrical housing.

28. An engine starter for an internal combustion engine, comprising:

a torque generating means including an electrically powered motor having an output shaft and a power train connected to the output shaft of said motor for amplifying torque generated by said motor, said train having an output shaft that rotates substantially slower than an output shaft of said electrically powered motor;

a cup means connected to an output shaft of said power train for receiving the output shaft of an internal combustion engine and transferring said amplified torque to said engine shaft to start said engine;

an over-speed clutch means for mechanically disengaging said cone means from said power train, when said internal combustion engine starts;

a housing for containing said over-speed clutch means and power train, and a rechargeable power source for powering said motor.

29. The portable storage container and engine starter of claim 28, wherein said rechargeable power source has an output of about 9.6 volts.

* * * * *